US005209864A

United States Patent [19]

Perry, Jr. et al.

[11] Patent Number: 5,209,864

[45] Date of Patent: May 11, 1993

[54] CAKE-LIKE DETERGENT AND METHOD OF MANUFACTURE

[75] Inventors: Hubert A. Perry, Jr.; Kenneth E. Perry, both of Wellesley, Mass.

[73] Assignee: Winbro Group, Ltd., Woburn, Mass.

[21] Appl. No.: 725,278

[22] Filed: Jul. 3, 1991

[51] Int. Cl.[5] ..... C11D 17/00; C11D 3/04; C11D 7/06

[52] U.S. Cl. ..... 252/134; 252/135; 252/156; 252/186.34; 252/186.35; 252/186.36

[58] Field of Search ..... 252/156, 135, 134, 90, 252/92, 93

[56] References Cited

U.S. PATENT DOCUMENTS

| | | | |
|---|---|---|---|
| Re. 32,763 | 10/1988 | Fennholtz | 252/90 |
| 2,164,092 | 6/1939 | Smith | 23/107 |
| 2,333,443 | 11/1943 | Robinson | 252/135 |
| 2,382,163 | 8/1945 | MacMahon | 252/138 |
| 2,382,164 | 8/1945 | MacMahon | 252/138 |
| 2,382,165 | 8/1945 | MacMahon | 252/135 |
| 2,412,819 | 12/1946 | MacMahon | 252/138 |
| 2,987,483 | 6/1961 | Brooker | 252/138 |
| 3,048,548 | 5/1959 | Martin et al. | 252/135 |
| 3,166,512 | 1/1965 | Mizuno | 252/99 |
| 3,166,513 | 1/1965 | Mizuno et al. | 252/99 |
| 3,174,934 | 3/1965 | Shen | 252/135 |
| 3,271,317 | 9/1966 | Otrhalek et al. | 252/135 |
| 3,291,576 | 12/1966 | Otrhalek | 23/302 |
| 3,306,858 | 2/1967 | Oberle | 252/99 |
| 3,390,093 | 6/1968 | Feierstein et al. | 252/138 |
| 3,417,024 | 12/1968 | Goldwasser | 252/135 |
| 3,441,511 | 4/1969 | Otrhalek et al. | 252/135 |
| 3,491,028 | 1/1970 | Crotty et al. | 252/103 |
| 3,535,258 | 10/1970 | Sabatelli et al. | 252/105 |
| 3,579,455 | 5/1971 | Sabatelli et al. | 252/135 |
| 3,639,286 | 2/1972 | Ballestra et al. | 252/109 |
| 3,649,545 | 3/1972 | Susuki et al. | 252/174 |
| 3,700,599 | 10/1972 | Mizuno et al. | 252/99 |
| 3,789,011 | 1/1974 | Tanaka | 252/367 |
| 3,816,427 | 6/1974 | Loliger et al. | 23/271 |
| 3,856,932 | 12/1974 | May | 424/16 |
| 3,899,436 | 8/1975 | Copeland et al. | 252/99 |
| 3,933,670 | 1/1976 | Brill et al. | 252/99 |
| 3,936,386 | 2/1976 | Corliss et al. | 252/99 |
| 4,014,808 | 3/1977 | Herpers et al. | 252/135 |
| 4,147,650 | 3/1979 | Sabatelli et al. | 252/103 |
| 4,294,280 | 10/1981 | Tom | 137/268 |
| 4,438,010 | 3/1984 | Lindauer et al. | 252/91 |
| 4,469,613 | 9/1984 | Munteanu et al. | 252/92 |
| 4,640,839 | 2/1987 | Hsu | 426/285 |
| 4,680,134 | 7/1987 | Heile et al. | 252/160 |
| 4,681,914 | 7/1987 | Olson | 252/91 |
| 4,753,755 | 6/1988 | Gansser | 252/527 |

*Primary Examiner*—Asok Pal
*Assistant Examiner*—P. Achutamurthy
*Attorney, Agent, or Firm*—Samuels, Gauthier & Stevens

[57] ABSTRACT

A method of making a solid cake-like detergent for ware and hard surface washing, which cake-like detergent is the product of hydration and sequestration reactions, which includes:

blending an alkali metal hydroxide and a hardness sequestering agent to form a dry powdered detergent mixture;

flowing the mixture to form a particulate stream;

moistening the particulate stream to form moistened particulates;

depositing the moistened particulates in a receptacle;

and forming the solid cake-like detergent in said receptacle.

32 Claims, 3 Drawing Sheets

CAKE-LIKE DETERGENT AND METHOD OF MANUFACTURE

FIELD OF INVENTION

This invention relates to a process for producing a solid cake-like detergent for use in institutional and industrial dishwashers and the cake-like detergent.

BACKGROUND AND BRIEF SUMMARY OF THE INVENTION

Detergents used in industrial and institutional ware-washing machines have been problematical, whether liquid, powder or solid detergents are used. These problems include: safety problems in handling the detergents, particularly high alkaline (more than 12% caustic) detergents; chemical stability; caking; softening; dehydration; homogeneity; and dispensing equal amounts of detergent and additives at a uniform rate. There are also manufacturing problems with the institutional and industrial detergents. Most of these problems have been adequately discussed in prior art. See Re. 32,763 and 32,818, and the references cited therein, for a discussion of such problems.

In order for a detergent to be effective, whether of high or low alkalinity, the detergent must be able to clean all surfaces, be dispensed uniformly and be used with minimal foaming. To meet these requirements, additives are combined with the detergent. Chlorine-based compounds and defoamers are the common additives used in these detergents. The chlorine-based compounds are particularly important for removing coffee and tea stains.

For industrial and institutional ware washing machines, the detergents used should have the characteristics of being dispensed from a container or the like uniformly, that is, at a controlled rate, into the wash water. Highly alkaline detergents are the most suitable for superior cleaning. In addition to the uniform dispensing of the detergent, the components of the detergent itself should be homogeneous such that there is no variation in the strength of the detergent delivered including any additives within the detergent. This homogeneity can be easily achieved with liquid detergents but for high alkaline solid detergents homogeneity has been difficult to achieve.

Prior to the liquid cast solid detergents disclosed in the above-referenced reissue patents, the problems of solid detergents were acknowledged to be the difficulty in forming solid detergents with high alkalinity which would provide a constant rate of delivery, in blending highly alkaline detergents with sequestering agents, and in mixing highly caustic materials in an aqueous solution to produce a homogeneous product. The other additives typically found in the detergents, such as chlorine-based compounds and defoamers, if added during the formation of the liquid cast solid detergents, could either react with the components, separate within the casting mass, and/or lose their efficacy. According to the disclosures of the reissue patents, the then prior art problems of the difficulty of safely forming a solid homogeneous detergent were overcome by forming an aqueous solution of an alkaline hydratable component and a hardness sequestering agent and then casting the liquid which, upon cooling, formed a hard solid product. Although the compositions disclosed in these patents overcame some of the prior art problems, the process for making such a liquid cast detergent is relatively time consuming.

As described in the reissue patents, a liquid composition is made under very carefully controlled conditions and the liquid composition cast into a receptacle. However, the liquid composition has to be continuously agitated and the temperature controlled up to the time when the liquid composition is cast. Although this process then represented an advance in the state of the art, the forming of the liquid composition further required careful control because of the mixing of the reactive components. Lastly, certain additives, such as surfactants and defoamers, could not simply be blended into the final liquid detergent composition mix in a uniform, dispersed manner.

The present invention is directed to a process which overcomes the problems of forming and casting liquid detergent compositions of non-compatible materials and to the product of the process. The inventive process and product eliminate the need to segregate within the solid detergent certain additives, such as surfactants and defoamers. The product of the invention has uniformly dispersed therethrough the major components of the detergent as well as the other additives. The detergent and additives are dispersed at a uniform rate.

With the process disclosed herein, a cake-like high-alkaline detergent is provided with less water content than other available solid detergents. This results in a cake-like detergent which therefore can deliver more cleaning power per unit weight.

Applicant's invention provides a solid cake-like detergent, which is homogeneous. Applicant's invention forms the homogeneous solid cake-like detergent by blending the components of the detergent as powders to form a dry detergent mixture, then flowing the dry powder mixture through a water spray, moistening the particulates, which then fall into a vibrating receptacle where the moistened powder detergent mix forms into a solid cake.

As used in this disclosure, the term flowing powder means that the particulates of the powdered detergent mixture can easily move and change their relative position within the mixture without separation from the stream such that there is intimate contact between the moisture and the particulates substantially throughout the flowing powder stream of particulates. That is, the particulates of the detergent mixture are distributed at a rate and in an amount such that the particulates flow in the flowing powder stream without being carried out of the system. Under this condition, the use of particulates tends to equalize the composition of the reaction mixture and temperature throughout the moving powder stream. This uniformity of mixing and temperature dispersion has successfully overcome the prior art problems of forming homogeneous high alkaline solid detergents.

DESCRIPTION OF THE PREFERRED EMBODIMENT(S)

Figure 1:
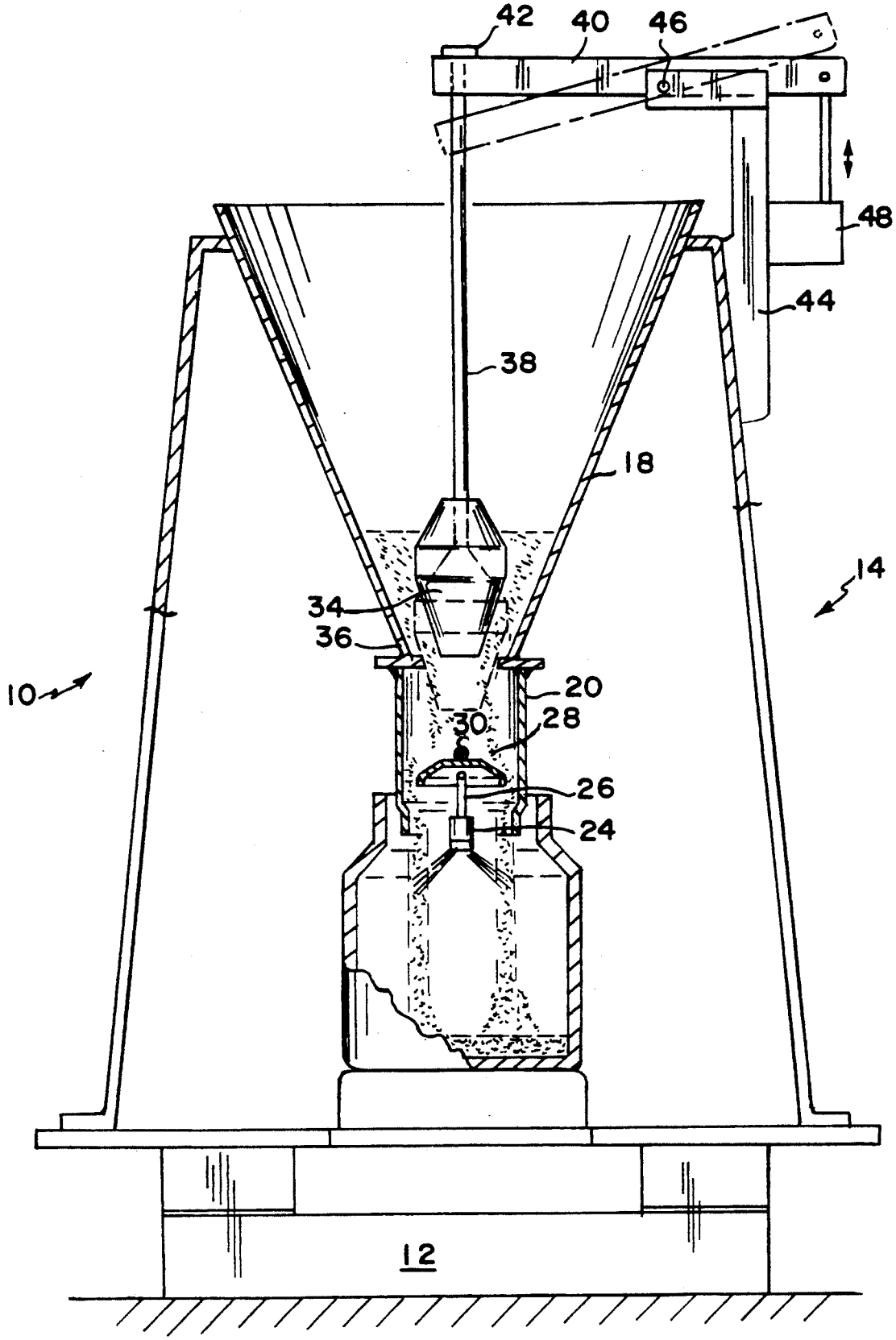
FIG. 1 is a front schematic of an apparatus for forming the cake-like detergent.

The detergent compositions disclosed herein are highly alkaline. Highly caustic components used for their cleaning properties include alkali metal hydroxides, such as sodium hydroxide and potassium hydroxide; silicates, such as sodium metasilicate; phosphates, particularly phosphates of the formula M—$PO_3$-M—OM or the corresponding cyclic compounds $$PO_3M—(—PO_3M—)_n—PO_3M,$$

wherein M is an alkali metal and n is a number ranging from 1 to about 60, typically less than 10 for cyclic phosphates, typical examples of such phosphates being sodium or potassium orthophosphate and alkaline condensed phosphates (i.e. polyphosphates) such as sodium or potassium pyrophosphate, etc.; carbonates such as sodium or potassium carbonate; borates, such as sodium borate; etc. including combinations of any of the preceding.

Use of a highly caustic or alkaline component per se typically causes etching on the wares being cleaned. Accordingly, it is common practice to use a second component, such as an alkali metal phosphate, for buffering the caustic ions which tend to etch the ceramic plates and the like being cleaned. Preferably, sodium tripolyphosphate is used.

Additionally, other conventional detergent components and fillers can be included. For example, it is common to include a source of available chlorine and a defoamer. Many chlorine sources can be used including encapsulated chlorinated isocyanurates, such as encapsulated sodium dichloroisocyanurate dihydrate, encapsulated hypochlorites, such as calcium and lithium hypochlorite, and encapsulated chlorinated phosphates. Encapsulated pelletized chlorine sources for use with detergents in warewashing are well known in the art.

Defoamers are also normally included in detergent compositions. Typically, a "defoamer" is a chemical compound with a hydrophobe/hydrophile balance suitable to reducing the stability of protein foam. The hydrophobicity can be provided by an oleophilic portion of the molecule (e.g. an aromatic alkyl or aralkyl group; an oxypropylene unit or oxypropylene chain, or other oxyalkylene functional groups other than oxyethylene, e.g. tetramethylene oxide). The hydrophilicity can be provided with oxyethylene units or chains or blocks and/or ester groups (e.g. organophosphate esters), salt-type groups, or salt-forming groups. Typically, defoamers are: nonionic organic surface-active polymers having hydrophobic groups or blocks or chains and hydrophilic ester-groups, blocks, units, or chains, but anionic, cationic, and amphoteric defoamers are known. Phosphate esters are also suitable, e.g. esters of the formula $RO(—PO_3M—)_nR$, wherein n is as defined previously and R is an organic group or M (as defined previously), at least one R being an organic group such as oxyalkylene chain. If a defoamer is included it may be blended with the detergent mix prior to moisturizing the particulates.

The caustic component or combination of caustic components will normally comprise at least 20% and up to 75% by weight of the detergent composition. The sequestering agent will normally comprise of from 10 to 40% by weight of the final cake-like composition. Although the sequestering agent has some causticity in and of itself, when the term caustic component is used in this disclosure, it means that component(s) which is used in the formulation solely for its cleaning properties.

The amount of water in the cake-like detergent will vary from 5 to 15% and typically is between 6 to 8%. As used in this disclosure, the term water includes both hydrated and free.

Performance-improving additives such as encapsulated available chlorine producing components and defoamers will normally comprise minor amounts of the composition, that is, 5 to 15%. The caked detergent composition can also contain a polyelectrolyte.

Typical three-component compositions of this invention can be formulated from (1) a phosphate or other hardness-precipitating or hardness sequestering agent, (2) an alkali metal hydroxide, and (3) water. Typical four or five component compositions would further include a defoamer and/or a neutral inorganic salt (alkali metal halides, sulfates, etc.) and/or an encapsulated chlorine source.

Figure 3:
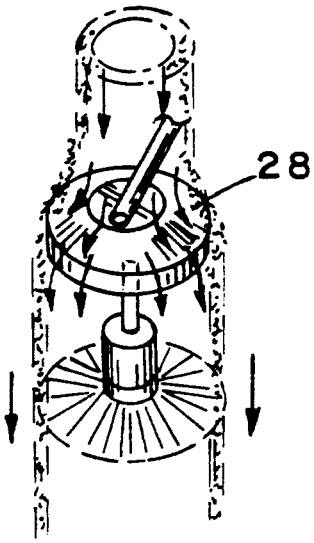
FIG. 3 is a perspective view of flowing moistened particles.

Referring to FIG. 1, an apparatus used to produce the detergent embodying the invention is shown generally at 10 and comprises a vibrator 12 to which is secured a four-legged frame 14. A cone-shaped hopper 18 is joined to the frame 14 and a throat 20 is secured to the discharge end of the hopper. A nozzle 24, which in the preferred embodiment is a hollow cone nozzle is secured in the lower end of the throat by a conduit 26 which is rigidly secured to and passes through the wall of the throat. The conduit is joined to a flexible connector and source of water (not shown). A baffle 28 is rigidly secured in the throat by a rod 30 joined to the throat. The baffle 28 defines an annular passageway 32. This is shown more clearly in FIG. 3.

A powder valve 34 seats in the bottom of the hopper at 36 and includes a stem 38. The stem 38 is adjustable with its upper threaded end passing through a bracket 40. An adjusting nut 42 determines the extent that the powder valve 34 will be withdrawn from the seat during operation. A bracket 44 is secured to one of the legs of the frame 14. The bracket 40 is pivotally attached to the bracket 44 at 46. Also secured to the bracket 44 is a solenoid valve 48 which drives the bracket 40. Thus, the opening and closing of the solenoid valve opens and closes the powder valve.

Figure 2:
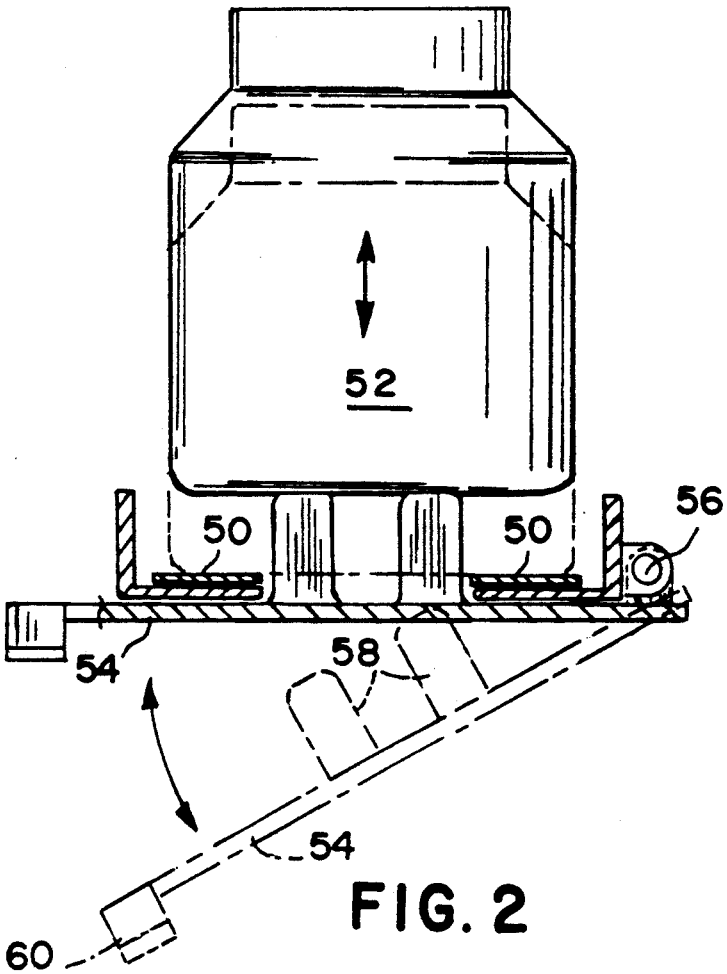
FIG. 2 is a side schematic of the container in which the cake is formed in a raised mixing position and a lowered non-mixing position.

Referring to FIG. 2, a conveyor comprises a pair of belts 50 on which a container(s) 52 are carried. The conveyor frame is not shown. A support plate 54 is pivotally joined to the base of the frame 14 at 56 which includes support blocks 58. The support plate has a handle 60 which is adapted to lock the plate 54 to the frame and actuate a start switch (not shown).

In the operation of the invention, the following components are dry blended to form a powdered detergent mixture.

| | % by weight |
|---|---|
| Powdered sodium hydroxide | 20–75 |
| Sodium tripolyphosphate | 10–40 |
| Sodium meta silicate, crystalline or anhydrous | 0–20 |
| Defoamer e.g. tetramethylene oxide | 0–2 |
| Encapsulated source of available | 0–15 |

-continued

| | % by weight |
|---|---|
| chlorine e.g. dichloroisocyanurate dihydrate pellets | |

An advantage of the invention is that in the powdered detergent mixture the additives, and particularly the chlorine source, can be incorporated therein without any adverse reaction while ensuring their homogeneous dispersion throughout the solid cake-like detergent.

Figure 5:
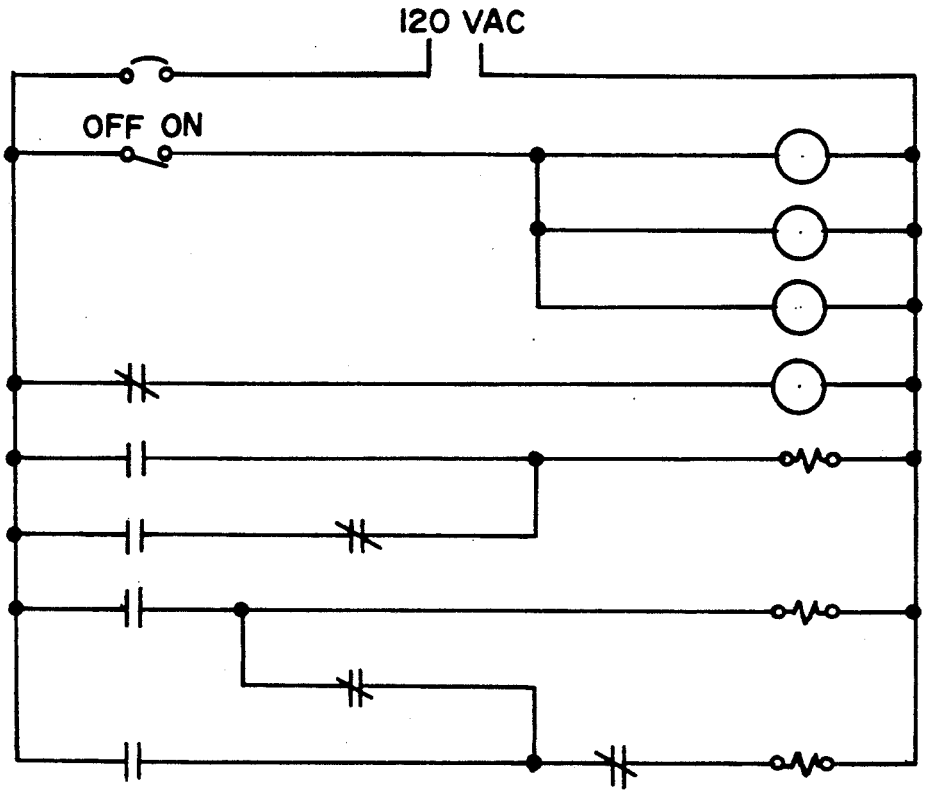
FIG. 5 is a schematic of the control circuit for the apparatus.

The mixture is placed in the hopper 18 with the valve 34 in its closed position. A container 52 is moved under the throat 20 and the support plate is closed to move the container from its lower to its upper position. When the support plate closes, a start switch 1 LS, see FIG. 5, is actuated which vibrates the frame and thereby the hopper and the container. Simultaneously, the water is sprayed into the throat at a variable rate, and the hopper valve is withdrawn from the throat of the container. The detergent mixture flows downwardly as a particulate stream strikes the baffle and in this, the preferred embodiment, continues to flow downwardly as an annular curtain. Also, the baffle ensures that powder does not contact the nozzle. The nozzle moistens the descending curtain of flowing particulate which then falls in its moistened condition into the vibrating container 52. The vibration stops and the hopper valve closes. The water spray continues approximately 1 second after the vibration has ceased and the valve has closed. The total time for processing a half-gallon container is approximately 10 seconds from the opening of the valve until the spray stops. The hardening process continues in the container for some minutes. The sequence is repeated for the next batch.

Each solid cake-like detergent weighs roughly 7¼ to 7½ pounds. About 8% or approximately 0.5 pounds of the final weight constitutes the total water content.

Figure 4:
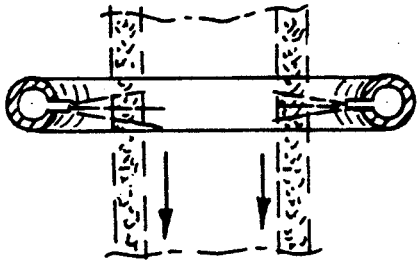
FIG. 4 is an alternative embodiment of an nozzle array.

Although our disclosure has described a particular nozzle and powder flow arrangement, as shown in FIG. 4, it is obvious that the water spray could circumscribe a falling column of flowing powder particulate. Other opening and closing mechanisms may be used and other types of valving arrangements may be used to discharge the powder into the hopper.

Figure 6:
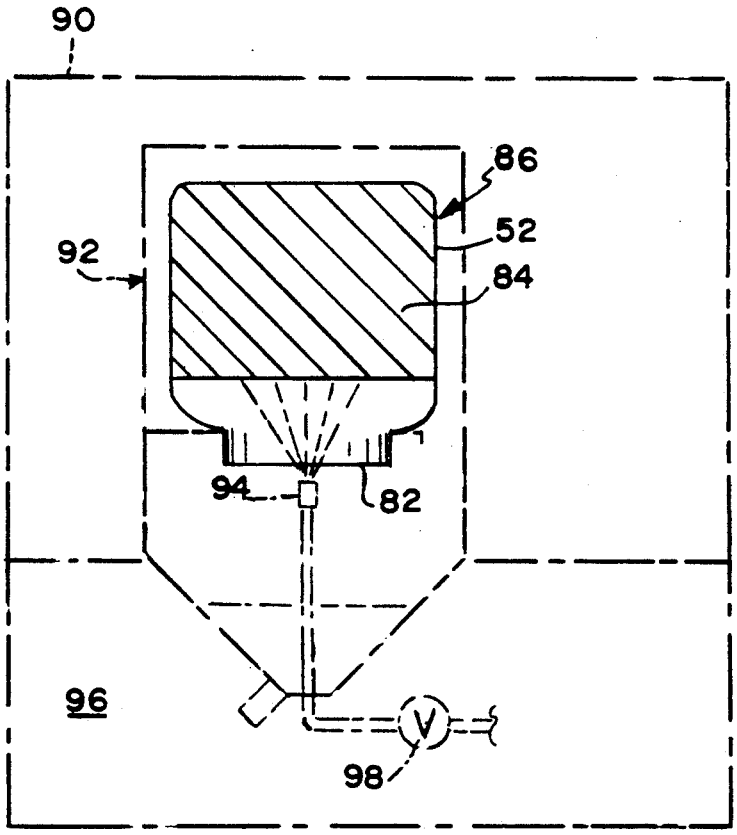
FIG. 6 is an illustration of the cake-like detergent in combination with a warewasher.

The detergent can be formed in a disposable container, a reusable container, in a mold and the solid detergent subsequently placed in another container, a plastic bag, wrap or the like. Referring to FIG. 6, the jar-shaped container 52 has an open top 82 and is filled with the cake-like detergent 84 to form a detergent package 86. A cover (not shown) can be secured to the container for storage and shipment and is removed before use.

The detergent package 86 can be placed in any properly equipped warewashing machine where typically the package 86 will be inverted. When detergent is required for a wash cycle, the detergent is contacted by water to dissolve the detergent which then flows into the appropriate sump.

Referring to FIG. 6, a prior art warewasher 90 includes a detergent dispensing device 92, with an upwardly extending spray nozzle 94 and a lower warewashing zone 94. The nozzle 94 controls the direction of the impingement of the water on the detergent 84. A valve 98 controls the duration of the impingement of the water on the detergent. The detergent flows into the warewashing zone 96. Because the additives, including chlorine, are dry blended and uniformly dispersed throughout, the detergents are uniformly dispersed into the warewashing zone.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described our invention, what we now claim is:

1. A method of making a solid cake-like detergent for ware and hard surface washing, which cake-like detergent is the product of hydration and sequestration reactions, which includes:

blending an alkali metal hydroxide and a hardness sequestering agent to form a dry powdered detergent mixture;

flowing the mixture to form a particulate stream;

moistening the particulate stream to form moistened particulates;

depositing the moistened particulates in a receptacle; and forming the solid cake-like detergent in said receptacle.

2. The method of claim 1 wherein the alkali metal hydroxide is selected from the group consisting of sodium hydroxide and potassium hydroxide, and the hardness sequestering agent is selected from the group consisting of silicates, phosphates, carbonates and borates.

3. The method of claim 2 wherein the phosphate is selected from the group consisting of $M—PO_3M—OM$ or cyclic $PO_3M—(—PO_3—)_n—PO_3M$ wherein M is an alkali metal and n is a number ranging from 1 to 60.

4. The method of claim 2 wherein the carbonates include sodium carbonate and potassium carbonate.

5. The method of claim 1 wherein the alkali metal hydroxide is hydratable.

6. The method of claim 1 wherein the sequestering agent is hydratable.

7. The method of claim 1 wherein the detergent mixture includes a chlorine compound

8. The method of claim 7 wherein the chlorine is encapsulated.

9. The method of claim 1 wherein the detergent mixture includes defoamers.

10. The method of claim 1 which includes:

flowing the powdered detergent mixture downwardly.

11. The method of claim 10 which includes:

flowing the powdered detergent mixture downwardly in the form of an annular curtain.

12. The method of claim 11 which includes:

contacting at least the inner surface of the annular curtain with water.

13. The method of claim 11 which includes:

contacting the entire curtain with water.

14. The method of claim 12 wherein the water is in the form of a cone-shaped spray, the perimeter of the base of the cone contacting the descending curtain.

15. The method of claim 11 which includes:

flowing the powdered detergent mixture over a baffle to form the descending curtain.

16. The method of claim 10 which includes:

moistening the powdered detergent mixture by contacting the outer surface of the downwardly moving mixture with water.

17. The method of claim 10 wherein the downwardly moving powdered detergent mixture comprises a plurality of columns.

18. The method of claim 1 which includes:

retaining the deposited moistened particulates in the receptacle while the particulates harden into the solid cake-like detergent.

19. The method of claim 18 wherein the receptacle is a thermoplastic receptacle.

20. The method of claim 1 which includes packing the mixture by vibrating.

21. A solid cake-like detergent for ware and hard surface washing formed according to the method of claims 1 or 2.

22. The solid cake-like detergent of claim 21 wherein the receptacle in which solid cake-like detergent is formed is the container for said cake-like detergent.

23. The solid cake-like detergent of claim 21 wherein the receptacle is a disposable container for said solid cake-like detergent.

24. A detergent composition which comprises:

a three-dimensional, uniform, solid, cake-like alkaline warewashing detergent which includes:

an alkali metal hydroxide;

an effective amount of a hardness sequestering agent; and a chlorine additive substantially uniformly dispersed throughout said cake-like detergent.

25. The composition of claim 24 wherein the alkali metal hydroxide is selected from the group consisting of sodium hydroxide and potassium hydroxide, and the hardness sequestering agent is selected from the group consisting of silicates, phosphates, carbonates and borates.

26. The composition of claim 25 wherein the alkali metal hydroxide is sodium hydroxide.

27. The composition of claim 24 wherein the hardness sequestering agent is a phosphate hardness sequestering agent.

28. The method of claim 26 wherein the phosphate is selected from the group consisting of $M—PO_3M—OM$ or cyclic $PO_3M—(—PO_3—)_n—PO_3M$ wherein M is an alkali metal and n is a number ranging form 1 and 60.

29. The composition of claim 25 wherein the carbonates include sodium carbonate and potassium carbonate.

30. The composition of claim 24 wherein the chlorine is encapsulated in pellet-like form.

31. The composition of claim 24 wherein the detergent mixture includes defoamers.

32. The method of claim 7 which comprises:

distributing homogeneously throughout the mixture the chlorine-compound.

* * * * *